US008245348B2

(12) United States Patent
Winter et al.

(10) Patent No.: US 8,245,348 B2
(45) Date of Patent: Aug. 21, 2012

(54) MANUAL TOOTHBRUSH

(75) Inventors: Florina Winter, Schmitten (DE); Jens Alinski, Kelkheim (DE); Heidrun Schmelcher, Oberursel (DE); Gerhard Schafer, Frankfurt am Main (DE); Holger Port, Schwalbach (DE); Manfred Klawuhn, Frankfurt am Main (DE); Frank Gliemroth, Schwalbach (DE)

(73) Assignee: BRAUN GmbH, Kronberg (DE)

( * ) Notice: Subject to any disclaimer, the term of this patent is extended or adjusted under 35 U.S.C. 154(b) by 0 days.

(21) Appl. No.: 12/823,824

(22) Filed: Jun. 25, 2010

(65) Prior Publication Data

US 2010/0257684 A1 Oct. 14, 2010

Related U.S. Application Data

(62) Division of application No. 10/583,289, filed on Nov. 7, 2006, now Pat. No. 7,805,796.

(30) Foreign Application Priority Data

Dec. 20, 2003 (DE) ..... 103 60 102

(51) Int. Cl.
*A46B 7/02* (2006.01)
*A46B 7/06* (2006.01)
*A46B 9/04* (2006.01)

(52) U.S. Cl. ..... 15/167.2; 15/167.1; 15/172; 15/201

(58) Field of Classification Search ..... 15/167.1, 15/167.2, 172, 201; D4/106
See application file for complete search history.

(56) References Cited

U.S. PATENT DOCUMENTS

| | | | | |
|---|---|---|---|---|
| 229,823 | A | 7/1880 | Holz et al. | |
| 1,137,916 | A | 5/1915 | Simmons | |
| 1,616,484 | A | 2/1927 | Beynon | |
| 1,894,509 | A | 1/1933 | Booth | |
| 1,932,878 | A | 10/1933 | Akizawa | |
| 1,968,303 | A | 7/1934 | McMath | |
| 2,122,619 | A | 7/1938 | McMath | |
| 2,306,264 | A * | 12/1942 | Hart | 15/27 |
| 3,065,479 | A | 11/1962 | McGee | |
| 4,333,199 | A | 6/1982 | Del Rosario | |
| 4,575,894 | A * | 3/1986 | Stevens et al. | 15/172 |
| 4,757,570 | A | 7/1988 | Haeusser et al. | |
| 5,072,481 | A | 12/1991 | Weyer | |
| 6,408,473 | B1 * | 6/2002 | Kessler | 15/104.94 |
| 2002/0157202 | A1 | 10/2002 | Hartel | |
| 2004/0025274 | A1 * | 2/2004 | Moskovich et al. | 15/167.1 |
| 2007/0169295 | A1 | 7/2007 | Winter et al. | |

FOREIGN PATENT DOCUMENTS

| | | |
|---|---|---|
| DE | 8690081 | 12/1988 |
| WO | WO 92/19125 | 12/1992 |
| WO | WO 95/12333 | 5/1995 |
| WO | 02/094057 | * 11/2002 |

OTHER PUBLICATIONS

Office Action for U.S. Appl. No. 10/583,289, dated Aug. 12, 2009; P&G Case Z-7924; Winter et al.; filed Nov. 7, 2006.

* cited by examiner

*Primary Examiner* — Mark Spisich
(74) *Attorney, Agent, or Firm* — George Henry Leal; James E. Oehlenschlager; Vladimir Vitenberg

(57) ABSTRACT

A manual toothbrush with a handle and a toothbrush head mounted on the handle. A pivot bearing for pivoting the toothbrush head relative to the handle is arranged between the toothbrush head and the handle.

4 Claims, 3 Drawing Sheets

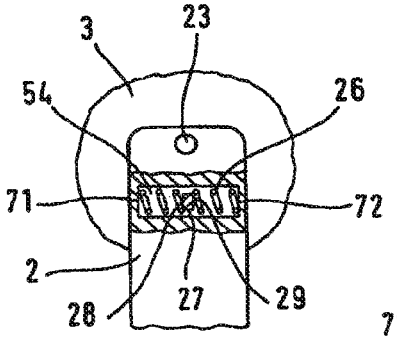
Fig. 6
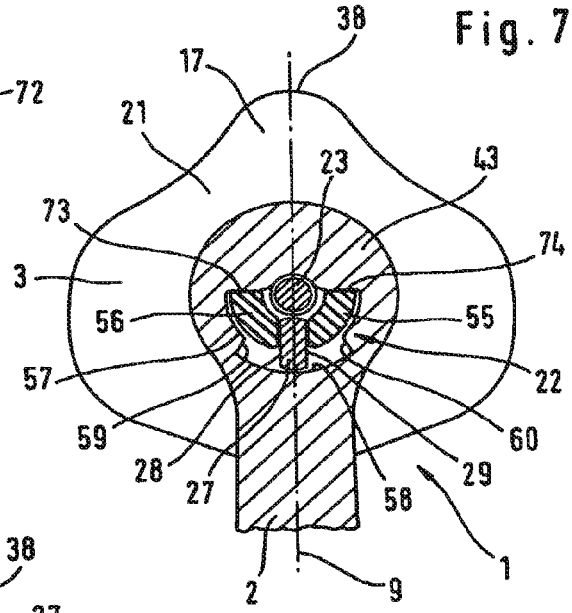
Fig. 7
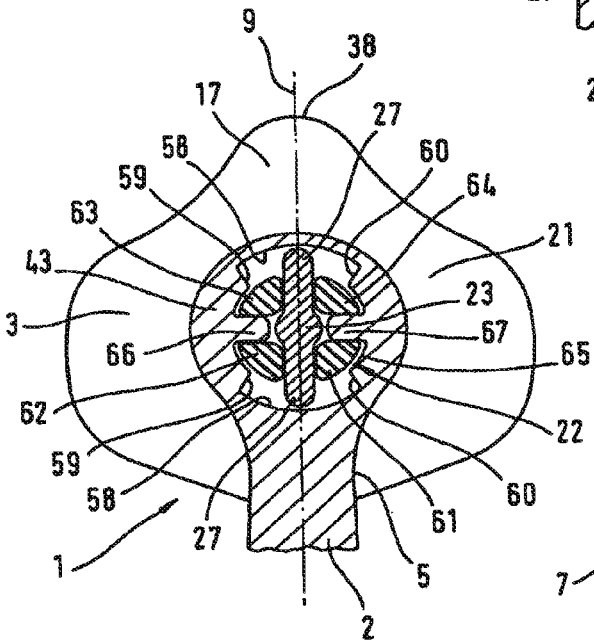
Fig. 8
Fig. 9
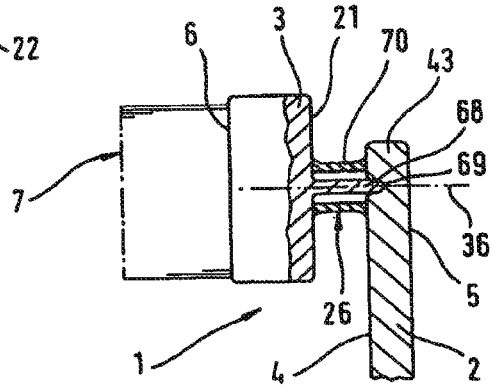

MANUAL TOOTHBRUSH

CROSS REFERENCE

This application is a divisional of U.S. application Ser No. 10/583,289, filed Nov. 7, 2006, now U.S. Pat. No. 7,805,796, the contents of which are incorporated herein by reference.

TECHNICAL FIELD

This application relates to a manual toothbrush.

BACKGROUND

Patent No. FR-2600512 A1 discloses a manual toothbrush including a toothbrush head and a toothbrush head carrier. The carrier is arranged in a U-shaped fashion such that bristle clusters arranged on the brushing side of the U-shaped carrier converge to form a receptacle space, into which individual teeth as well as part of the gums can penetrate. During brushing, the bristle clusters simultaneously clean the inside and the outside surfaces of both the teeth and marginal gums.

A pivot bearing connects the toothbrush head to the handle and allows the toothbrush head to pivot about the handle. Because the toothbrush head is free to pivot about the handle, the U-shaped carrier of the toothbrush head continuously encompasses the teeth during brushing. Thus, the opposing bristles are always directed essentially perpendicular to the inside and outside surfaces of the teeth and gums.

Nevertheless, the prior art design requires the toothbrush head to be aligned with a row of teeth for each newly beginning brushing process such that it can be placed over the teeth and is not oriented transverse thereto.

SUMMARY

In one aspect of the invention, a manual toothbrush includes a handle, a toothbrush head mounted on the handle, bristle clusters extending along a surface on the brushing side of the toothbrush head to form a receptacle space for teeth, a pivot bearing arranged between the toothbrush head and the handle for pivoting the toothbrush head relative to the handle during the brushing process, and a spring element arranged between the toothbrush head and the handle to move the toothbrush head back to its unpivoted position after the brushing process. The spring element engages on the toothbrush head and is supported in the handle with the other end, ensuring that the toothbrush head always assumes a predefined position relative to the handle in the unpivoted position of the manual toothbrush.

For example, if the receptacle space formed between the edge regions of the bristle clusters extends in the longitudinal direction of the handle, a user guides the toothbrush head to the teeth in the direction in which the teeth extend. The direction of the handle also assumes the direction of the teeth, i.e., when brushing the molars that are directed toward the rear of the oral cavity, the handle is also held in this direction such that the receptacle space also assumes this position and therefore can be easily placed over the teeth without requiring complicated manipulations.

If the handle is slightly pivoted relative to the toothbrush head, the pressure exerted upon the tooth flanks on the inside and the outside of the teeth can be respectively increased or decreased under the control of the spring, thereby improving the brushing of the teeth.

The cleaning of the toothbrush head is also simplified because it can yield to hand movements during the cleaning process by simultaneously building up a spring force, but the toothbrush head does not rotate.

In some embodiments, the pivoting axis of the bearing extends transverse or angled to the longitudinal axis of the handle. This can help to realize the customary brushing position for most manual toothbrushes such that the handling is simplified. If the pivot bearing is arranged underneath the bristles, i.e., approximately centered relative to the toothbrush head, the teeth are uniformly brushed on both edges if the bristle clusters are symmetrically arranged in the edge regions. However, the pivot bearing may also engage on the toothbrush head eccentrically.

In certain embodiments, the pivot bearing limits the pivoting range of the toothbrush head relative to the longitudinal axis to less than 30° (e.g., to 20°). Restricting the pivoting range of the toothbrush head can allow use of realistic and feasible spring element solutions. Also, when changing from the molars to the incisors, this pivoting range makes it possible to realize a manual change in direction of the handle in order to achieve larger pivoting angles, namely similar to a toothbrush head that is rigidly fixed on a handle.

In some embodiments, the toothbrush head includes bristle clusters arranged such that the inside and outside surfaces of the teeth can be simultaneously brushed. This orientation of bristle clusters can make it possible to clean both the biting surfaces of the molars and the cutting surfaces of the incisors directly from above. Even if no bristle clusters extend into the receptacle space from the bottom, the biting and cutting surfaces can also be treated by configuring the bristle clusters arranged in the lateral edge region near the bottom such that they protrude toward the center and therefore can treat the biting and cutting surfaces during the brushing process. These embodiments also allow optimal cleaning of the chewing surfaces with a separate bristle section on the bottom of the toothbrush head.

In certain embodiments, a bristle section may protrude from the bottom of the receptacle space on the surface of the brushing side of the toothbrush head. For example, a bristle cluster section may protrude on the free front end of the toothbrush head at the height of the receptacle space. This bristle cluster section can help to provide a superior brushing result of the chewing and cutting surfaces of the teeth.

In some embodiments, a bristle cluster section may be approximately centered relative to the receptacle space and protrude from the free front end of the toothbrush head, and this bristle cluster section may further protrude over a bristle section situated on the bottom of the receptacle space. This configuration may allow the bristle clusters arranged in the edge regions to lie obliquely opposite one another and to enclose the receptacle space for accommodating the teeth. The more concave the surface, the more significant the convergence of the bristle clusters on the edge regions and the more perpendicular their alignment relative to the lateral surfaces of the teeth. However, the alignment of the individual bristle clusters does not only depend on the alignment of the surface of the toothbrush head on the brushing side, but also the angle by which the individual bristle clusters protrude from the surface on the brushing side. Using both measures, the lateral surfaces of the toothbrush head do not have to be substantially angled relative to the bottom. Consequently, the installation of the bristle clusters using a bristle fitting machine can be significantly simplified.

In certain embodiments, the receptacle space is open toward the handle, to simplify the placement of the toothbrush head around the teeth and the handling of the toothbrush. For example, the surface on the brushing side of the toothbrush head may be essentially concave, with this surface extending transverse to the longitudinal direction of the handle and further including a front bristle cluster section arranged on an extension centrally aligned with and adjoining the front end of the toothbrush head. As another example, the receptacle space may be open toward the end of the handle that lies farther from the toothbrush head. In these embodiments, the toothbrush head may be slightly angled relative to the chewing surfaces of the teeth because the bristle cluster section causes the distance between the toothbrush head and the chewing surfaces to be greater on the front end than on the open end of the receptacle space. This can help to ensure that the handle assumes a position in which it protrudes from the mouth with a slight downward angle while the body is in an upright posture such that an improved hand position and therefore improved handling may be achieved.

In certain embodiments, one end of the spring element is fixed either on the toothbrush head or on the handle using a pivot bearing. The pivot bearing includes a pin that engages a receptacle opening arranged on either the toothbrush head or the handle. The other end of the spring element contacts a stopping element arranged to adjoin both sides of the spring element. This end of the spring element is supported either on the toothbrush head or the handle by the stopping element. If the toothbrush head pivots in one direction while brushing the teeth, the stopping element contacts the free end of the spring element and bends the spring element such that a restoring force is generated. Once pressure is removed from the toothbrush head, the spring element presses the stopping element to move the toothbrush head opposite to the actuated direction returning the toothbrush head into its unpivoted position. When the toothbrush head is in its unpivoted position, the tension of the spring is zero. If the toothbrush head is pivoted in the other direction, the stopping element presses the free end of the spring in the other direction and bends the spring such that a prestress is generated. Once released, the spring presses the stopping element to move the toothbrush head back into its unpivoted position.

Although the toothbrush head is subjected to a restraint during the brushing process due to the bristle clusters enclosing the row of teeth, it pivots back into its unpivoted position if the alignment of the row of teeth allows such pivoting. If the toothbrush head is pivoted during the brushing process, a restoring moment acts upon the toothbrush head. Because of this restoring moment, the bristles have a tendency to adjoin the teeth and therefore to clean and to massage the surface of the teeth and gums during the movement of the manual toothbrush.

These embodiments may allow simpler mounting of the toothbrush head on the handle while also allowing the toothbrush head to pivot back and forward relative to the longitudinal axis of the handle.

In some embodiments, the pin is long enough to penetrate a bore in the handle and a short section of the pin protrudes on the other end of the handle. This short section is widened by plastic deformation, e.g. under the influence of pressure or elevated temperatures, thereby engaging the free end of the pin behind the bore to a rivet head. In addition or in the alternative, other mounting solutions may be used to attach the pin to the bore. For example, a retaining ring that also engages behind the bore may be attached on the rear of the pin. As another example, a snap-on connection may engage into a groove arranged on the pin and thus hold the toothbrush head on the handle in a rotatable fashion using the pin. As still another example, a screw that engages behind the bore may be screwed on the free end of the pin from the rear side.

In some embodiments, the spring element includes a leaf spring or a rod spring. The leaf spring may include a strip cut out of a thin sheet and subsequently deformed into its final shape by means of a bending tool. Additionally or alternatively, the spring may include a rod with a round, quadrangular, oval or any other cross section. The material of the leaf spring or the rod spring may include spring steel that is corrosion-resistant to water, saliva, toothpaste, foods and other substances that are present while brushing the teeth.

Spring elements including a leaf spring or a rod spring can provide a particularly simple adjusting device that can be easily mounted and generates sufficient restoring forces. With such spring elements, one limb may cause the restoring movement in one direction and the other limb may cause the restoring movement in the opposite direction.

In some embodiments, the spring element is arranged in a U-shape and formed by a crosspiece connecting two limbs to one another. A guide arbor engages between the limbs on the crosspiece, in that the pin penetrates the limbs at a distance from the guide arbor, and the stopping element engages the free ends of the limbs. For example, the stopping element can be a projection produced during the injection-molding of the plastic toothbrush or the plastic toothbrush head. The pin and the transverse web may also be produced during the injection-molding of the plastic toothbrush or the plastic toothbrush head.

In some embodiments, the leaf spring or rod spring extends essentially linearly. One end of the spring is fixed in the handle and the other end is fixed in the toothbrush head. The center of the spring element is either fixed in the toothbrush head or in the handle and the two opposite free ends form the elastic ends that contact the stopping element. The stopping element is arranged on the component that does not carry the spring element. The stopping element is arranged such that, when the toothbrush head is turned in one direction, one stopping surface of the stopping element contacts the free end of the spring element while the other stopping surface moves away from the other free end of the spring element. The distant stopping surface contacts the spring element when the toothbrush head is turned in the other direction and the opposite stopping surface moves away from the spring element. These embodiments may be provided without high assembly and manufacturing expenditures.

In some embodiments, one free end of a leaf spring or rod spring is fixed on the handle. The other pivoted end is connected to an intermediate carrier that can be pivoted about the free end of the handle. If the intermediate carrier can be clipped on the toothbrush head, the intermediate carrier pivots the toothbrush head on the leaf spring or rod spring. To prevent compressive forces from being transmitted to the spring element, the intermediate carrier or the toothbrush head is additionally supported on the surface of the handle.

In certain embodiments, the spring element includes a coil spring. The free ends of the coil spring are fixed in one of the two toothbrush components, i.e., either on the handle or on the toothbrush head. A stopping element connected to either the toothbrush head or the handle engages in the center of the coil spring,thereby prestressing one half of the spring element elastically in one direction while the other half is relieved. If the toothbrush head is pivoted in the other direction, the exact opposite conditions occur. These embodiments may allow particularly high forces to be exerted on the toothbrush head during pivoting because the spring functions as both a tension spring and a pressure spring as the toothbrush head pivots.

In some embodiments, the spring element includes one or more elastomers made of plastic. The elastomers are inserted into a recess that is arranged either in the toothbrush head or in the handle. Projections provided on the other component press against the elastomers when the toothbrush head is pivoted, generating a restoring moment that acts upon and causes the toothbrush head to return into its unpivoted position. For example, a recess may be arranged on the handle to engage with the pin and the stopping element, and one or more elastomers may be fixed in the recess to both sides of the stopping element.

The spring force can be varied using an elastomer that has the same shape, but is made of a different material. Two elastomers may allow different spring characteristics to act upon the toothbrush head in one pivoting direction.

In some embodiments, the spring element is an elastomer connecting the toothbrush head to the handle. For example, an elastomer may be injection-molded between the toothbrush head and the handle to connect the two components to one another. The connecting length of the elastomer between the handle and the toothbrush head can be chosen to allow the elastomer to generate an acceptable restoring force. The elastomer connection acts as a torsion rod. The bearing point is not in contact with the elastomer, thereby transmiting the forces acting upon the toothbrush head directly to the handle. This direct transmission of forces allows better adjustment of the brushing forces.

In some embodiments, webs or a sleeve-shaped section connect(s) the handle to the toothbrush head, allowing simple elastic mounting of the toothbrush head on the handle. The webs or sleeve-shaped section is/are injection-molded to the rear side of the toothbrush head and on the surface of the handle. A journal is supported on the surface of the handle and extends from the rear side of the toothbrush head into the spring element. The webs or sleeve-shaped section can also be mounted to the toothbrush and the handle with a bonding process. The elastic mounting of the toothbrush head on the handle allows the toothbrush head to adapt itself to the row of teeth during the brushing process because the toothbrush head can be easily turned or pivoted relative to the handle. The pivoting resistance of the toothbrush head relative to the handle can be varied by choosing the hardness of the respective elastomer accordingly.

In certain embodiments, a blind bore is arranged on the handle, and the journal engages into the blind bore. The pressing force exerted on the handle by the hand and transmitted from the handle to the tooth surface by the toothbrush head is directly supported on the handle. However, a pivoting movement is still possible because the pin pivots in the blind bore and elastically deforms the webs or the sleeve-shaped section made of elastomer. During the deformation, the elastomer is subjected to flexural, torsional, compressive and tensile stresses.

Other features and advantages of the invention will be apparent from the following detailed description, from the drawings, and from the claims.

BRIEF DESCRIPTION OF THE DRAWINGS

FIG. 6 is a schematic representation of the underside of a manual toothbrush with an expanded coil spring and a stopping element arranged on the handle and engaging the center of the coil spring.

FIG. 7 is a longitudinal section through a handle of a manual toothbrush in the region of a bearing, with spring elements formed of elastomers.

FIG. 8 is a longitudinal section through a handle with four elastomer sections used as a spring element.

FIG. 9 is a longitudinal section that transversely extends through a manual toothbrush with a toothbrush head that is connected to the handle by an elastomeric torsion rod.

DETAILED DESCRIPTION

Figures 1, 2, 3:
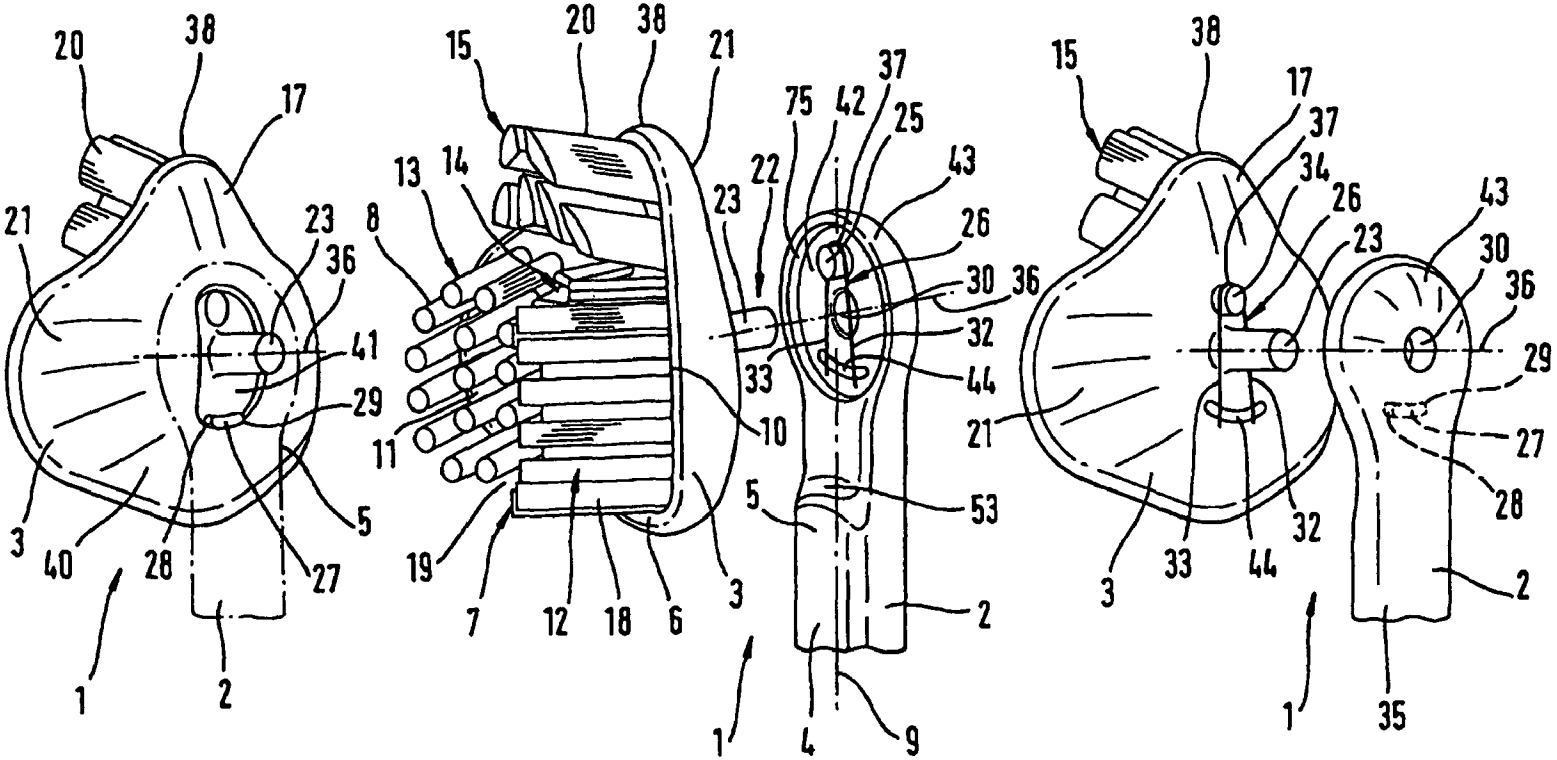
FIG. 1 is a partial, perspective view of an underside of a toothbrush head.
FIG. 2 is an exploded perspective side view of the toothbrush head of FIG. 1 and, the upper portion of a handle, with a spring provided in the handle and a stopping element provided on the toothbrush head.
FIG. 3 is a partial view of the underside of the toothbrush head according to FIG. 1, with the spring inserted on the underside of the toothbrush head and the stopping elements provided in the handle.

In FIGS. 1-9, a manual toothbrush 1 includes a handle 2 that is only partially illustrated in the figures and a toothbrush head 3 that is mounted on a bearing head 43 on a front end 5 of an upper side 4 of the handle 2. The toothbrush head 3 features a surface 6 on the brushing side, from which bristle sections 12, 13, 14, 15 (FIGS. 2 and 5) protrude. The bristle sections 12, 13, 14, 15 include several bristle clusters 8 and collectively form a bristle arrangement 7. The surface 6 on the brushing side is provided in a concave or shell-like bent fashion such that outer edge regions 10, 11 face one another about a longitudinal axis 9 in FIGS. 2 and 5. The outer edge regions can, for example, extend upward from the upper side 4 of the handle 2.

Figure 4:
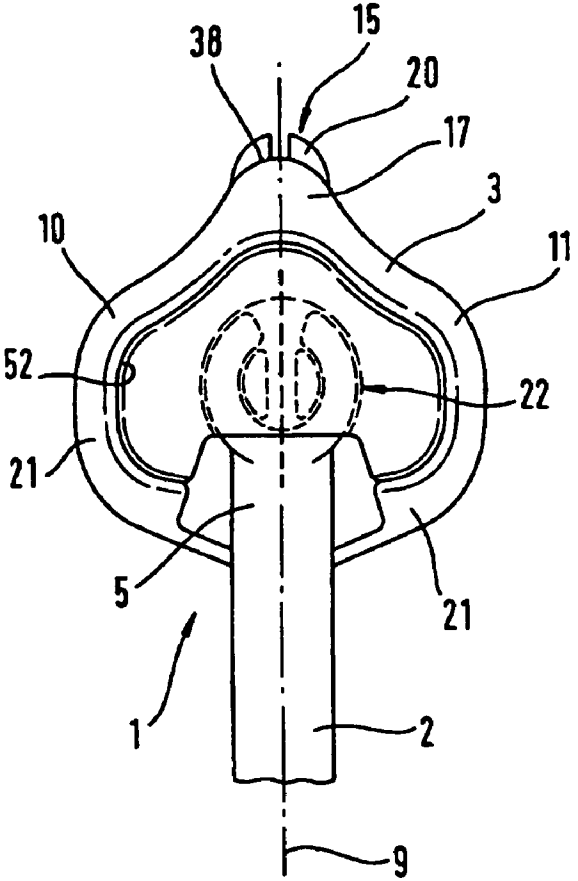
FIG. 4 is a bottom view of the end of a toothbrush including a toothbrush head.

Referring to FIG. 4, the toothbrush head 3 extends essentially transverse to the handle 2 and features an extension 17 on its front region. Viewed from a rear side 21, toothbrush head 3, in this embodiment, has an outer contour similar to that of a "manta ray."

Figure 5:
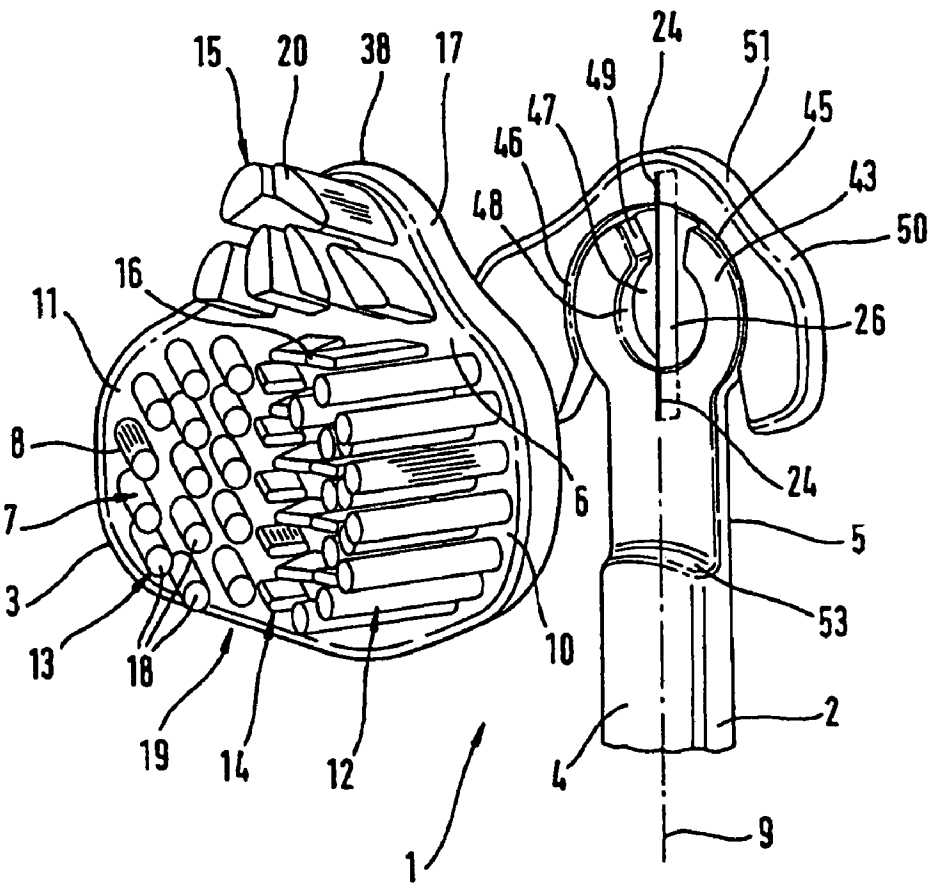
FIG. 5 is an exploded perspective top view of a toothbrush head and handle.

According to the embodiment in FIGS. 2 and 5, the rows of the bristle sections 12, 13, 14, 15 essentially extend in the direction of longitudinal axis 9. In this embodiment, the bristle section 14, if viewed from the top, is substantially rectangular and extends centrally in the bottom. The cross sections of the individual bristle clusters 16 form elongated ovals that extend transverse to the longitudinal axis 9 in this embodiment. The bristle sections 12 and 13 are laterally adjacent to the central bristle section 14 and protrude essentially perpendicularly from the obliquely elevated surface 6 on the brushing side. The individual bristle clusters 8 of the bristle sections 12 and 13 may have a round cross section of identical diameter. The bristle sections 12 and 13 include three rows of the bristle clusters 18, the outer edge row of which essentially follows the contour of the edge of the toothbrush head 3, forming an outwardly curved outer row.

The bristle clusters 18 may extend perpendicular to the surface 6 on the brushing side such that the bristle clusters 18 converge due to the curved elevated surface 6. The bristle clusters 18 may converge to create a receptacle space 19 between the ends of the bristle clusters 18. The receptacle space 19 may have such dimensions that the bristle ends of bristle clusters 18 are able to treat the chewing and cutting surfaces as well as the inside and the outside surfaces of the tooth equally well. Depending on the inclination on the edges of the surface 6 on the brushing side, the bristle clusters 18 may also protrude from the surface in an inclined fashion.

The upper side of the outwardly open receptacle space 19 may be limited by the bristle section 15, which includes the bristle clusters 20. Bristle clusters 20 are essentially quadrangular or trapezoidal in cross section and are slightly inclined toward a front point 38 of toothbrush head 3. The free ends of the front bristle clusters 20 protrude upward beyond the contour of the toothbrush head 3. The bristle section 15 can act like a closed, thick bristle cluster that reaches the rearmost molars particularly well during the brushing process due to its inclination. In addition, the individual cross sections of the front bristle clusters 20 and therefore also the overall cross section that forms the bristle section 15 are larger per surface unit compared to the entire brushing surface 6. Accordingly, the front bristle clusters 20 can generate a higher resistance to the tooth surfaces during the brushing of the rear molar regions and the rear molars are cleaned particularly well.

The rear of the receptacle space 19, as shown in FIGS. 2 and 5, is open toward the handle 2 such that teeth more easily engage into the receptacle space 19 from the rear side without encountering significant resistance and the toothbrush head 3 is better guided by the teeth. In this case, the toothbrush 1 is held at the handle 2 such that it protrudes from the mouth at a slight downward angle.

Referring to FIGS. 1-3 and 7-9, rear side 21 of the toothbrush head 3 is provided with a bearing arrangement 22 that cooperates with the toothbrush head 3 and the handle 2. As shown in FIGS. 1-3, a bearing arrangement 22 includes a pin 23 that protrudes approximately centrally from the toothbrush head 3 on the rear side 21.

Referring to FIGS. 1-2, a plane 41 around the pin 23 is recessed relative to an outer surface 40 of the rear side 21 and, in the assembled state of the handle 2 and the toothbrush head 3, may serve as a limiting surface for partially accommodating a spring element 26. On the other side, the spring element 26 is oriented on the face of a depression 75 on the bearing head 43. Spring element 26 may be limited by the bearing head 43. A stopping element 27 protrudes outward from the rear side 21 underneath the pin 23. The stopping element 27 features lateral stopping surfaces 28, 29 that engage between limbs 32, 33 of the spring element 26 in the assembled state.

Referring to FIG. 2, a bore 30 extends through the bearing head 43 to receive the pin 23 in a precisely fitted fashion. The center of the pin 23 forms a pivoting axis 36, about which the pin 23 can be pivoted in the bore 30. In the embodiments shown FIGS. 1-9, the angle between the longitudinal axis 9 of the handle 2 and the pivoting axis 36 is approximately 90 degrees. In other embodiments, this angle may be larger or smaller than 90 degrees. A guide arbor 25 protrudes centered relative to the longitudinal axis 9 above the bore 30, and the spring element 26 in the form of a U-shaped leg extends around the guide arbor 25. In the assembled state of the manual toothbrush 1, the free ends of the limbs 32, 33 adjoin the stopping surfaces 28, 29 of the stopping element 27. In this embodiment, the stopping element 27 engages into a corresponding depression 44 on the bearing head 43. The lateral dimensions of the depression 44 can be large enough to allow the stopping element 27 sufficient lateral clearance when the toothbrush head 3 is pivoted about the longitudinal axis 9 within a permitted angular range.

In some embodiments, as shown in FIG. 3, the spring element 26 (e.g., leg spring) is positioned around a guide arbor 34, which protrudes from the rear side 21 of toothbrush head 3. The limbs 32, 33 of the spring element 26 adjoin the pin 23. The stopping element 27 (illustrated with broken lines in FIG. 3) is provided on the handle 2. The depression 44 for accommodating the stopping element 27 and the spring element 26 is provided on the toothbrush head 3 and extends around the pin 23 on the rear side 21.

Referring again to FIG. 2, to mount the toothbrush head 3 on the handle 2, the spring element 26 is initially placed on the guide arbor 25 such that the limbs 32, 33 extend along the edge of the bore 30. The pin 23 is then inserted into the bore 30 and the toothbrush head 3 is displaced toward the handle 2 until the stopping element 27 engages between the limbs 32, 33 and the ends the limbs adjoin the stopping surfaces 28, 29 of the stopping element 27. The free end of the pin 23 that protrudes beyond the bore 30 to the underside 35 of handle 2 may then be subjected to a plastic deformation from the rear such that the free end of the pin is widened and extended beyond the edge of the bore 30 in a rivet-like fashion.

In another embodiment, a retaining ring may be inserted into a groove on the free end of pin 23 after attaching the toothbrush head 3 to the bearing head 43. The retaining ring can be supported on the rear side 21 of the toothbrush head 3 and thus holds the toothbrush head 3 on the handle 2 in a pivoted fashion. Alternatively, a the pin 23 may include a transverse bore for accommodating a cotter pin. It should be appreciated that screw connections or other conventional mounting means may alternatively or additionally be used to mount the toothbrush head 3 on the handle 2. In certain embodiments, mounting parts to be used are made of plastic.

In use, the toothbrush head 3 can be placed on the teeth such that a row of teeth longitudinally engages into the receptacle space 19. For example, if the toothbrush head 3 is placed on the front incisors, the handle 2 is held in the approximate direction of the front row of teeth, i.e., such that the handle tangentially extends away from the tooth surface. The handle 2 can be held such that it is slightly inclined downward relative to the cutting surfaces of the teeth and the teeth completely fill out the open region of the receptacle space 19. When handle 2 is held in this orientation, the bristle section 15 lies approximately on and laterally adjoins the cutting surfaces of the teeth.

When transferring the toothbrush head 3 from the incisors to the molars, the toothbrush head 3 can pivot about the pin 23 on the bearing head 43 if the handle 2 is not readjusted. A stopping surface 28 or 29 elastically presses either limb 32 or 33 of the spring element 26 outward. The other limb 33 or 32 is supported on the pin 23 such that the region of the spring element 26 extending around the guide arbor 25 is bent under the influence of the applied force. This force is continuously exerted upon the lateral tooth surfaces, namely on the inside and the outside surfaces, thereby improving the brushing result. The transverse forces exerted upon the lateral walls of the teeth diminish below a noteworthy value if the longitudinal axis 9 of the handle 2 extends symmetric to the longitudinal axis of the toothbrush head 3 and the handle 2 extends in the longitudinal direction of a row of teeth. However, because the alignment of the teeth rarely corresponds to the movements of the handle 2, the elastic pivoting of the toothbrush head 3 causes the toothbrush head to adapt to the respective row of teeth.

The spring element 26 can exert a clockwise as well as a counterclockwise torque upon the toothbrush head 3. The manual toothbrush 1 with U-shaped bristle arrangement 7 can help to provide limited decoupling of the toothbrush head 3 from the handle 2, resulting in improved guiding during the brushing process.

Referring to FIGS. 4 and 5 the spring element 26 is a leaf spring. The spring element (e.g., leaf spring) 26 extends linearly and is pressed into slots 24 in the handle 2 and in an intermediate carrier 50. In this embodiment, a circular outer surface 45 forms the pivoting surface, and the pivoting axis of the intermediate carrier 50 remains approximately centered on the bearing head 43. As shown in FIGS. 4 and 5, a bearing surface 46 may be provided in the shape of a graduated circle and adjoin the outer surface 45. Referring to FIG. 5, the spring element 26 protrudes from a face 47 such that the upper end of the spring element 26 can pivot laterally in a frictionless fashion. In this embodiment, the spring element 26 is embedded in a depression 48 that is opened toward the top by means of a slot 49, thereby enabling the spring 26 to move freely in the lateral directions when the bearing head 43 is pivoted.

Referring to FIGS. 4 and 5, the intermediate carrier is connected to the toothbrush head 3 by rigidly inserting an outer edge 51 of the intermediate carrier 50 into a corresponding recess 52 arranged on the rear side 21 of the toothbrush head 3. It should be appreciated that intermediate carrier 50 can be connected to toothbrush head 3 using other techniques, such as clipping, pressing, or bonding. In some embodiments, the intermediate carrier 50 can be manually disengaged at any time and be a replaceable component. For example, the intermediate carrier 50 may be disengaged from the toothbrush head 3 and replaced when the bristle clusters 16 of the bristle sections 12-15 become worn out. As shown in the embodiments in FIGS. 2 and 5, a step 53 can be arranged on the upper side 4 of the handle 2 to maintain the structural height of toothbrush 1 as low as possible.

Referring to FIG. 6, the toothbrush head 3 is mounted on the handle 2 in a rotatable fashion by a pin 23. In this embodiment, the spring element 26 is a coil spring. The spring element (e.g., coil apring) 26 is inserted into a receptacle space 54 arranged on the handle 2, wherein a stopping element 27 engages into the region of a central winding of the coil spring. If the toothbrush head 3 is pivoted to the left or the right about the pin 23, the corresponding outer stopping surface 28 or 29 engages on a spring winding such that a corresponding section of the spring 26 is prestressed while the other section is relieved. The spring element 26 is laterally supported on the stopping surfaces 71, 72 in the receptacle space 54. The prestress of one half of the spring element 26 pivots the toothbrush head 3 back into its unpivoted position shown in FIG. 6 after it is released. In this embodiment, the spring element 26 may include a wire spring that is coiled or injection-molded of plastic.

Referring to FIG. 7, the spring element 26 includes two trapezoidal elastomer pieces 55, 56 that are inserted into a recess 57 on the bearing head 43. The stopping element 27 is integrally molded on the bearing head 43 and engages between the two elastomer pieces 55, 56 such that the stopping surfaces 28, 29 of the stopping element adjoin the lateral surfaces of the elastomer pieces 55, 56. The stopping element 27 engages into a bulge 58 that widens downward and is laterally limited by the boundary surfaces 59, 60. In use, when the toothbrush head 3 is pivoted, the boundary surfaces 59, 60 serve as stops relative to the stopping element 27, thereby limiting the pivoting range in both directions. The elastomer pieces 55, 56 are supported on boundary surfaces 73, 74 in the bulge 57, and the other respective ends of the elastomer pieces are supported on the stopping element 27.

Referring to FIG. 8, four elastomer pieces 61-64 are guided in a recess 65. These four elastomer pieces are spaced apart in the longitudinal direction by two diametrical stopping elements 27 on the pin 23. The free ends of stopping elements 27 also engage into bulges 58 that feature the lateral boundary surfaces 59, 60 for limiting the pivoting angle of toothbrush head 3 similar to the device in FIG. 7. In the horizontal direction, elastomer pieces 61-64 are limited by projections 66, 67 that are integrally molded on the bearing head 43 and extend into close proximity with the pin 23.

If the toothbrush head 3 is turned in the clockwise direction, the upper right and elastomers 64 and 62 are prestressed while the two other elastomers 63 and 61 lie free. If the toothbrush head 3 is turned in the counterclockwise direction, the exact opposite conditions occur and the elastomers 63, 61 are prestressed while the elastomers 64, 62 are relieved.

Referring to FIG. 9, a journal 68 extending from the rear side 21 of the toothbrush head 3 engages into a blind bore 69 arranged on the bearing head 43 of the handle 2 and adjoins the bottom thereof. On the rear side 21 of the toothbrush head 3 as well as on the upper side 4 of the bearing head 43, a sleeve-shaped elastomer ring 70 is injection-molded around the journal 68. The elastomer serves as a spring element 26 for elastically returning the toothbrush head 3 into its unpivoted position after it is turned and after it is axially pivoted. The toothbrush head 3 is supported on the bottom of the blind bore 69 by the journal 68.

Instead of using an elastomer sleeve 70, it would also be possible to injection-mold individual (not-shown) interconnected webs on the surface 4 of the handle 2 and on the rear side 21 of the toothbrush head 3. The individual interconnected webs can be injection-molded using thermoplastic elastomer (TPE). The handle 2 and the toothbrush head 3 can be made of polypropylene. These same materials can also be used in embodiments similar to the embodiments shown in FIGS. 6 and 8.

What is claimed is:

1. A toothbrush having a handle and a head portion secured to the handle, the head portion comprising:

a movable head which can be pivoted from a first position to a second position when a force is applied to the movable head in a first direction;

a bearing head, having a recess, extending from the handle,; and an elastomeric spring element, oriented in the recess of the bearing head engaging the movable head and the bearing head such that once the force applied to the movable head in the first direction is removed, the elastomeric spring element applies a force to the movable head in a second direction, opposite the first direction, such that the movable head is moved from the second position back to the first position; and wherein the bearing head comprises stopping surfaces, wherein the elastomeric spring comprises elastomer pieces which are laterally spaced apart, and wherein the elastomer pieces adjoin the stopping surfaces of the bearing head.

2. The toothbrush of claim 1, wherein the elastomeric spring element is oriented on a face of the recess.

3. The toothbrush of claim 1, wherein the elastomeric spring element can exert clockwise and counterclockwise torque upon the movable head.

4. A toothbrush having a handle and a head portion secured to the handle, the head portion comprising:

a movable head which can be pivoted from a first position to a second position when a force is applied to the movable head in a first direction;

a bearing head, having a recess, extending from the handle,; and an elastomeric spring element, oriented in the recess of the bearing head engaging the movable head and the bearing head such that once the force applied to the movable head in the first direction is removed, the elastomeric spring element applies a force to the movable head in a second direction, opposite the first direction, such that the movable head is moved from the second position back to the first position;

wherein the bearing head comprises stopping surfaces, wherein the elastomeric spring comprises elastomer pieces which are laterally spaced apart, and wherein the elastomer pieces adjoin the stopping surfaces of the bearing head; and wherein the stopping surfaces are disposed in the recess.

* * * * *